US006854737B2

(12) United States Patent
Fieger et al.

(10) Patent No.: US 6,854,737 B2
(45) Date of Patent: Feb. 15, 2005

(54) SEAL ARRANGEMENT FOR AN EXPANSION MOTION JOINT

(75) Inventors: Frank Fieger, Velbert (DE); Andreas Trawicki, Oberhausen (DE)

(73) Assignee: MIGUA Fugensysteme GmbH & Co. KG, Wuelfrath (DE)

( * ) Notice: Subject to any disclaimer, the term of this patent is extended or adjusted under 35 U.S.C. 154(b) by 0 days.

(21) Appl. No.: 10/377,126

(22) Filed: Feb. 26, 2003

(65) Prior Publication Data

US 2004/0080121 A1 Apr. 29, 2004

(30) Foreign Application Priority Data

Feb. 27, 2002 (DE) ..... 102 08 359

(51) Int. Cl.[7] ..... F16J 15/02; E04B 1/70

(52) U.S. Cl. ..... 277/630; 277/637; 277/641; 52/302.6

(58) Field of Search ..... 277/628, 634, 277/637, 641, 642–644, 650–651, 654; 52/35, 58, 60–62, 302.6

(56) References Cited

U.S. PATENT DOCUMENTS 4,374,442 A * 2/1983 Hein et al. ..... 14/73.1
4,674,252 A * 6/1987 Nicholas et al. ..... 52/396.06
4,793,162 A * 12/1988 Emmons ..... 404/69
5,575,126 A * 11/1996 Attaway et al. ..... 52/396.02
5,791,111 A * 8/1998 Beenders ..... 52/396.05
6,419,238 B2 * 7/2002 McComb ..... 277/630

FOREIGN PATENT DOCUMENTS

DE 10025178 C1 * 10/2001 ..... E04B/01/68
EP 1158101 11/2001

* cited by examiner

*Primary Examiner*—Robert J. Sandy
*Assistant Examiner*—Vishal Patel
(74) *Attorney, Agent, or Firm*—W. F. Fasse; W. G. Fasse

(57) ABSTRACT

In a sealing apparatus (1*a*) for an expansion joint (2) between two structure bodies (4) with a flexible bridging unit (13*a*) and two anchoring units (8*a*) which are arranged on opposite sides of the expansion joint (2) and each comprises an integral flange (9*a*) which can be connected with the associated structure body and a lapped flange (10*a*) which can be secured by a clamping element (11*a*) to the integral flange (9*a*) in the manner of a dovetail connection, with the bridging unit being connectable with the anchoring units in such way that it is clamped between the integral flange (9*a*) and the lapped flange. The clamping element (11*a*) substantially has the same strength as the integral flange (9*a*).

13 Claims, 4 Drawing Sheets

19
11a
13a
34
9a 11a
13a
9a 11a
13a
9a
19

11a
13a
9a
19

11a
13a
9a
19

11a
13a
9a
19

11a
13a
9a
19

11a
13a
9a
19

SEAL ARRANGEMENT FOR AN EXPANSION MOTION JOINT

PRIORITY CLAIM

This application is based on and claims the priority under 35 U.S.C. §119 of German Patent Application 102 08 359.2, filed on Feb. 27, 2002, the entire disclosure of which is incorporated herein by reference.

FIELD OF THE INVENTION

The invention relates to a sealing device for an expansion joint between two structures. The device has a flexible bridging unit and two anchoring units which are situated on opposite sides of the expansion joint. Each unit comprises an integral or fixed flange which can be connected with the structure body and a lapped or overlapping flange which can be braced with the fixed flange by means of a clamping element in the manner of a dovetail joint. The bridging unit is connectable with the anchoring units in such a way that it is clamped between the integral or fixed flange and lapped or loose flange.

BACKGROUND INFORMATION

Sealing devices are used for example for bridging expansion joints between concrete slabs in order to cover the expansion joint and to prevent the penetration of foreign bodies or liquids on the one hand and to allow secure driving and walking on parking decks without placing excessive loads on the mutually opposite edges of the structural bodies. Generally, known sealing devices comprise two anchoring units which are each connected with the structure bodies at mutually opposite edges and between which a substantially elastic bridging unit is braced.

Each anchoring unit substantially consists of an integral flange and a lapped flange, with the integral flange being fixedly connected with the respective structure body by means of screwed connections for example. The lapped flange can be connected with the integral flange in such a way that the bridging unit is clamped in a gap formed between the two. Generally known are sealing apparatuses in which the lapped flange is connected with the integral flange by means of a screwed connection penetrating the bridging unit. Such sealing apparatuses have proven to be disadvantageous because an opening is mandatorily produced with the penetration of the bridging unit which allows the penetration of humidity to the integral flange and to the expansion joint.

The screwed connected ranging from the surface of the anchoring unit to the integral flange further constitutes an electrically as well as thermally conductive connection to the structure body. Such conductive connections are frequently undesirable both for security reasons as well as bridges for the cold.

A sealing apparatus of the above generic kind is known from EP 1 158 101 A2. The integral flange comprises a dovetail-like groove through whose opening cross section at first the bridging unit and then a clamping element connected with the lapped flange can be guided during the mounting. By shortening a press element, the clamping element is elastically compressed and widens in the direction of the width of the groove. In this way it presses against the mutually opposite bearing surfaces of the groove that in this region a non-positive connection is achieved between the integral flange, the bridging unit, the clamping element and the lapped flange. The use of a dovetail connection with an elastic clamping element already eliminates the disadvantageous penetration of the bridging unit and further facilitates and accelerates the mounting of the sealing apparatus.

One disadvantage of the sealing apparatus according to EP 1 158 101 A2 is the fact, however, that the connection of the lapped flange with the integral flange, and thus also the fixing of the bridging unit, is considerably less tight as in known screwed connections. It is feared that when driving over such a sealing apparatus transversally to the expansion joint, especially in the case of extreme acceleration or braking processes of truck vehicles for example, the clamping element pressed into the groove would be unable to withstand the occurring shearing forces transversally to the longitudinal axis of the sealing apparatus could be torn out of said groove with the lapped flange.

SUMMARY OF THE INVENTION

The invention is based on the object of providing a sealing device for bridging an expansion joint whose connection of lapped flange and integral flange will also meet the extreme requirements that must be met when vehicles drive over the expansion gap. The device must be easily and quickly installed without penetrating the bridging unit.

The invention further aims to avoid or overcome the disadvantages of the prior art, and to achieve additional advantages, as apparent from the present specification. The attainment of these objects is, however, not a required limitation of the present invention.

The foregoing objects have been achieved in accordance with the invention in such a way that the clamping element substantially has the same strength as the integral flange. If the lapped flange is braced by the clamping element with the integral flange in the manner of a dovetail connection, the strength of the connection is not limited by the material of the clamping element. A displacement of the lapped or loose flange with respect to the integral flange is only possible to the extent to which the bridging unit which is clamped between the two flanges, is compressible. An elastic deformation of the clamping element and the tearing out from the connection under excessive load need not be expected.

The sealing apparatus in accordance with the invention is arranged in the manner for example that an integral flange comprises a dovetail-like spring extending in the longitudinal direction of the sealing apparatus on whose mutually opposite bearing surfaces rest on the on e hand the lapped flange and on the other hand the clamping element. The sealing apparatus can then be mounted in an especially simple manner because the delivery of the lapped flange and clamping element to the respective bearing surfaces is not obstructed.

A further and preferred embodiment of a sealing apparatus in accordance with the invention comprises an integral flange with a dovetail-like groove, and with the clamping element resting on one or both mutually opposite bearing surfaces of the groove. The groove is then open in the direction towards the lapped flange. For mounting such a sealing apparatus the clamping element is introduced into the groove through an opening cross section of the groove. The clamping element is advantageously arranged in such a way that, when it is tilted thereafter about the longitudinal axis of the groove, it can no longer be removed from the groove without tilting.

The sealing apparatus in accordance with the invention preferably comprises a screw for connection of the lapped flange and clamping element, with the screw head resting on the lapped flange. Such an arrangement simplifies and accelerates the mounting and thus lowers the production costs of the sealing apparatus. Especially preferably screws with a self-cutting thread are used which engage in the clamping element in a groove extending in the longitudinal direction of the sealing apparatus. On the one hand, this enables the production of the clamping element as a continuous or rod-shaped merchandise. On the other hand, mounting is facilitated in such a way that no fixed position of the clamping element with respect to the lapped flange needs to be observed.

The bridging unit of a sealing apparatus in accordance with the invention can be equipped with a sealing lip extending in the longitudinal direction of the sealing apparatus, which sealing lip is inserted during the mounting of the sealing apparatus into a respective groove of the integral flange. Such a sealing lip improves the sealing effect of the sealing apparatus. Moreover, the mounting of the sealing apparatus is also facilitated in this way because the region of the bridging unit inserted into the dovetail connection is not pulled out by its weight.

BRIEF DESCRIPTION OF THE DRAWINGS

In order that the invention may be clearly understood, it will now be described in connection with example embodiments, with reference to the accompanying drawings, wherein.

DETAILED DESCRIPTION OF THE PREFERRED EMBODIMENTS AND OF THE BEST MODE OF THE INVENTION

Figure 1:
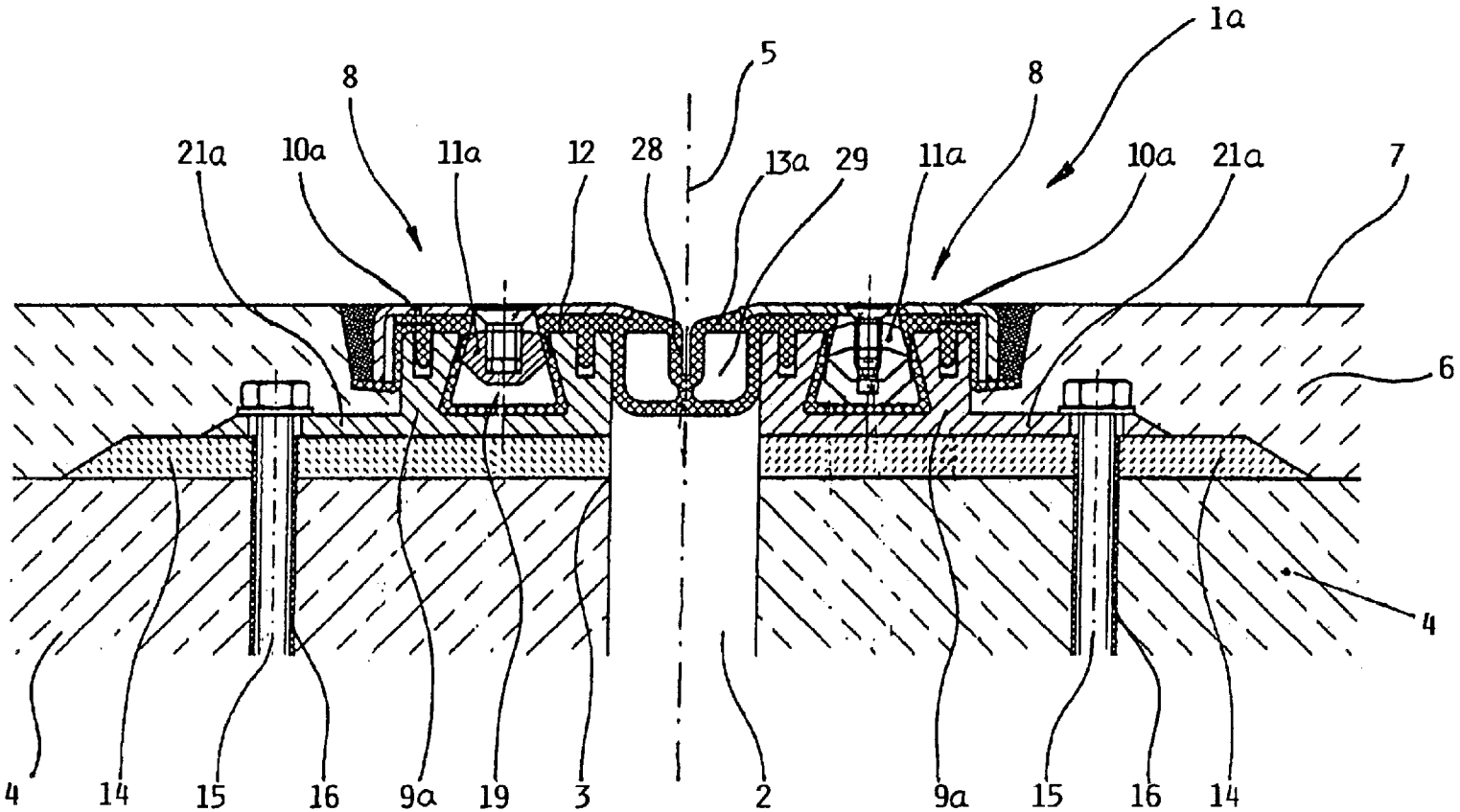
FIG. 1 shows a cross-sectional view through a first embodiment of the present sealing apparatus.

The sealing apparatus 1*a* covers and protects the upwardly open expansion joint 2 between the mutually opposite edges 3 of two structure bodies 4. FIG. 1 shows this arrangement in a sectional view perpendicular to the longitudinal direction of the expansion joint 2. The sealing apparatus 1*a*, which is shown here in an exemplary manner, is arranged in a mirror-symmetrical fashion relative to a perpendicularly extending central plane 5 of the expansion joint 2. Sealing apparatuses (not shown herein) without such a symmetry are used for other applications.

The structure bodies 4 each comprise a useful layer 6 which in this case is an asphalt paving with a traffic surface 7. An anchoring unit 8 is flush with the traffic surface 7 of said layer at the two edges 3 of the structure body 4. The anchoring units 8 each comprise an integral flange 9*a* and a lapped flange 10*a* which are braced by means of clamping elements 11*a* in the manner of a dovetail connection and which hold in a gap 12*a* between the integral flange 9*a* and the lapped flange 10*a* a rubber-elastic bridging unit 13*a* which spans the expansion joint 2. The integral flanges 9*a* are held on a compensating layer 14 and are anchored in the structure bodies 4 by means of screws 15 and dowels 16.

Figure 2:
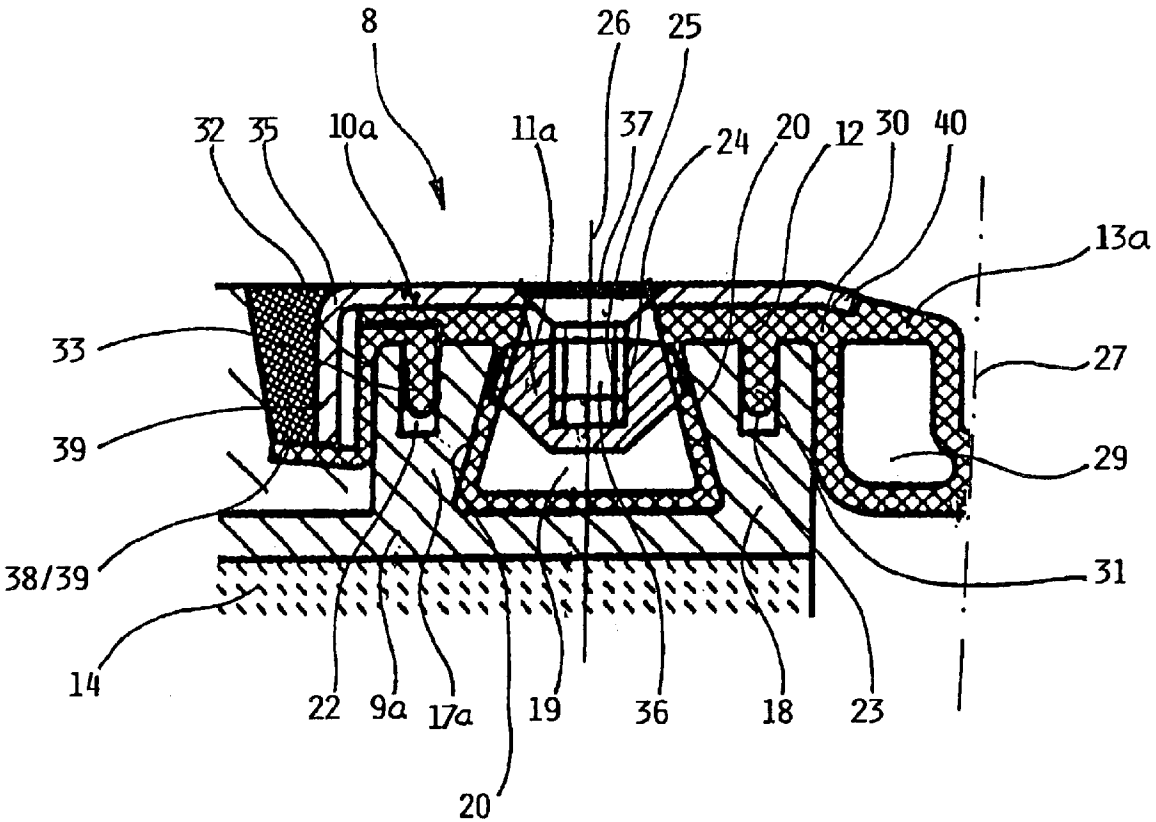
FIG. 2 shows, on an enlarged scale a portion of the sealing apparatus of FIG. 1.

FIG. 2 shows in an enlarged detail of the sealing apparatus 1*a* the connection of an integral flange 9*a* and the associated lapped flange 10*a*. The integral flange 9*a* comprises an upwardly open dovetail groove 19 with mutually opposite bearing surfaces 20 between a holding leg 17*a* and a relief leg 18. The holding leg 17*a* and the relief leg 18 project beyond a horizontally extending end section 21*a* of the integral flange 9*a* and provide the same with the shape of an F. The holding leg 17*a* and the relief leg 18 are provided with rectangular sealing grooves 22 and 23. The holding leg 17*a*, the relief leg 18, the dovetail groove 19, the end section 21*a* and the sealing grooves 22 and 23 extend perpendicular to the illustrated sectional view in the longitudinal direction of the integral flange 9*a* configured as an extruded aluminum profile.

The lapped flange 10*a* is a strip of steel sheet with a cross section which is bent off in an L-shaped manner and comprises a plurality of sunk bores 24 arranged successively behind each other at the same distance in its longitudinal direction extending perpendicular to the illustrated sectional view. The clamping element 11*a* comprises a substantially hexagonal cross section and a groove 25 extending in its longitudinal direction and is arranged in a mirror-symmetrical fashion with respect to a central plane 26 of the groove 25. The clamping element 11*a* is also made of an extruded aluminum profile.

The rubber-elastic bridging unit 13*a* is provided with a mirror-symmetrical arrangement with respect to a central plane 27 extending in its longitudinal direction perpendicular to the illustrated section view. In the mounted state, the bridging unit 13*a* comprises in said central plane 27 a groove 28 which is open in the direction of the useful layer 6, which groove is bordered on either side by a substantially rectangular, closed hollow profile 29 and, adjacent thereto, a thin holding strip 30. The holding strips 30 are secured to the hollow profiles 29 in such a way that, when mounting occurs, both are flush in the direction of the useful layer 6. On the side opposite of the useful layer 6, a sealing lip 31 is attached to the holding strips 30, respectively.

When mounting the illustrated sealing apparatus 1*a*, the integral flanges 9*a* are aligned at first with the opposite edges 3 of the structure bodies 4 on the compensating layer 14 and then fixed. The useful layer 6 is then applied. Thereafter the rubber-elastic supplementary strips 32 are positioned which engage with the sealing lip 33 in the sealing grooves 22 of the holding legs 17*a*. The sealing lips 33 are provided with a toothing (not shown) against inadvertent extraction from the sealing grooves 22. The supplementary strips 32 grasp around the holding legs 17*a* and end on the useful layer 6, which is sunk with respect to surface 7 thereby connecting to the integral flanges 9*a*.

The bridging unit 13 *a* is then positioned in such a way that the holding strips 30 engage in the dovetail grooves 19, and that the sealing lips 31 functioning as mounting aids, engage in the sealing grooves 23 of the relief legs 18. The holding strips 30 overlap in the region of the holding legs 17*a* with the supplementary strips 32 and, together with the same, ensure an effective sealing in the direction towards the surface 7.

Figures 3A, 3B, 3C, 3D, 3E, 3F, 3G, 3H:
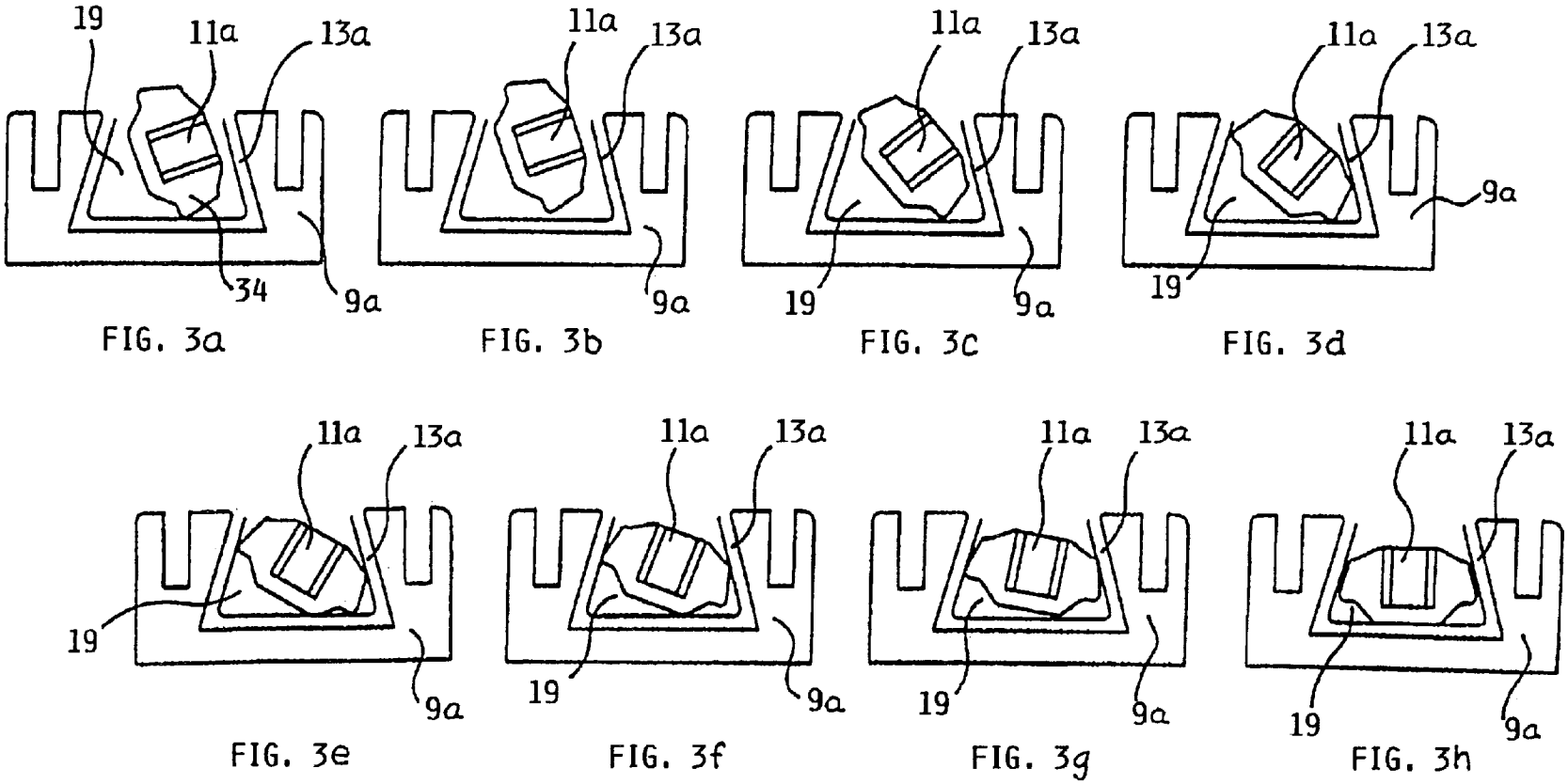
FIGS. 3*a* to 3*h* show a sequence of mounting steps for installing the apparatus of FIG. 1.

FIGS. 3*a* to 3*h* show a schematically substantially simplified representation of successive stages of the now occurring insertion of the clamping element 11*a* into the dovetail groove 19 in which a holding strip 30 of the bridging unit 13 *a* is already positioned. The clamping element 11*a* is swiveled according to FIG. 3*a* relative to the mounting position about its longitudinal axis by approximately 90° and introduced with a narrow side 34 at first into the dovetail groove 19, swiveled back about its longitudinal axis according to FIGS. 3*b* to 3*g* until it rests, as is shown in FIG. 3*h*. in the mounted position in the dovetail groove 19. Without a renewed swiveling of the clamping element 11*a* about its longitudinal axis the same cannot be removed from the dovetail groove 19 again.

The lapped flange 10*a* is then placed in such a way that the shorter, bent leg 35 of the lapped flange 10*a* grasps around the holding leg 17*a* of the integral flange 9*a*. Self-cutting counter-sunk head screws 36 are introduced into the groove 25 of the clamping element 11*a* through the bores 24 of the lapped flange 10*a*.

By tightening the countersunk head screws 36, whose heads 37 rest on the sunk bores 24 of the lapped flange 10*a*, the clamping element 11*a* in the dovetail groove 19 is pulled in the direction towards the lapped flange 10*a* and rests on the mutually opposite bearing surfaces 20 of the dovetail groove 19. In this way the lapped flange 10*a* is fixedly connected with the integral flange 9*a* on the one hand. On the other hand, the holding strip 30 of the bridging unit 13*a* resting in the dovetail groove 19 is clamped between the bearing surfaces 20 of the dovetail groove 19 and the clamping element 11*a* and is fixed in its position.

To complete the mounting of the illustrated sealing apparatus 1*a*, the intermediate space 38 formed between the bent leg 35 of the lapped flange 10*a* and the useful layer 6 is filled with a jointing compound 39.

The lapped flange 10*a* and the jointing compound 39 are flush with the drivable surface 7 of the useful layer 6, so that an arrangement is obtained which can be driven over in a substantially jolt-free fashion by a vehicle (not shown) in connection with a comparatively small offset between the lapped flange 10*a* and the bridging unit 13*a* in the expansion joint 2. Horizontal forces which are introduced into the lapped flange 10*a* are supported by the bent leg 35 of the lapped flange 10*a* and the comparatively stiff jointing compound 39 in the useful layer 6. The clamping elements 11*a* are therefore not subjected to any considerable dynamic horizontal forces.

The same effect of a horizontal force relief of the clamping elements 11*a* is achieved by a convexly curved edge strip 40 of the lapped flange 10 which faces the expansion joint 2 and which projects into the expansion gap cross section across the relief leg 18. Since the bridging unit 13*a* in the expansion joint 2 is slightly recessed with respect to the traffic surface 7 of the useful layer 6, the same is nearly completely protected from contact with the vehicle wheels.

Figure 4A:
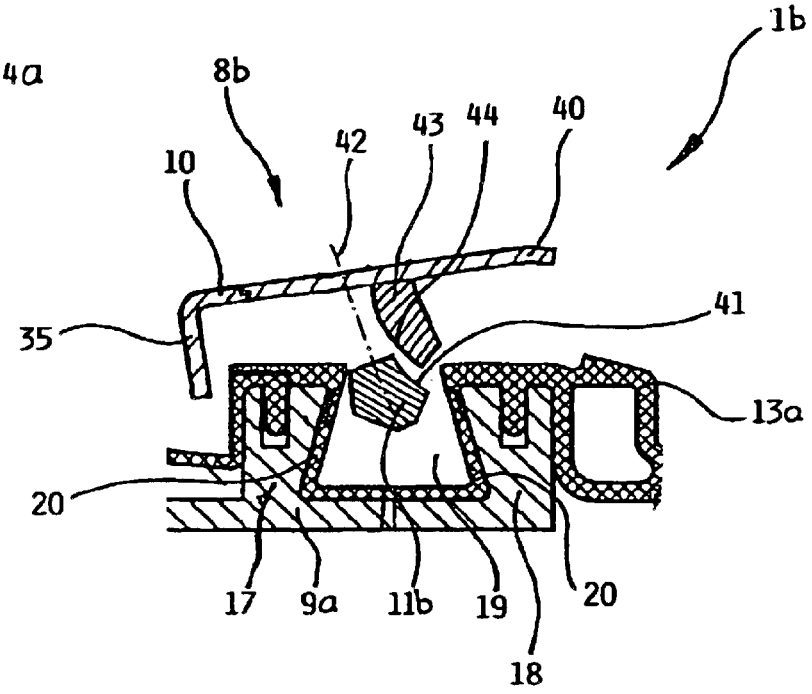
FIGS. 4*a* and 4*b* show mounting for installing a second embodiment of the present sealing apparatus.
Figure 4B:
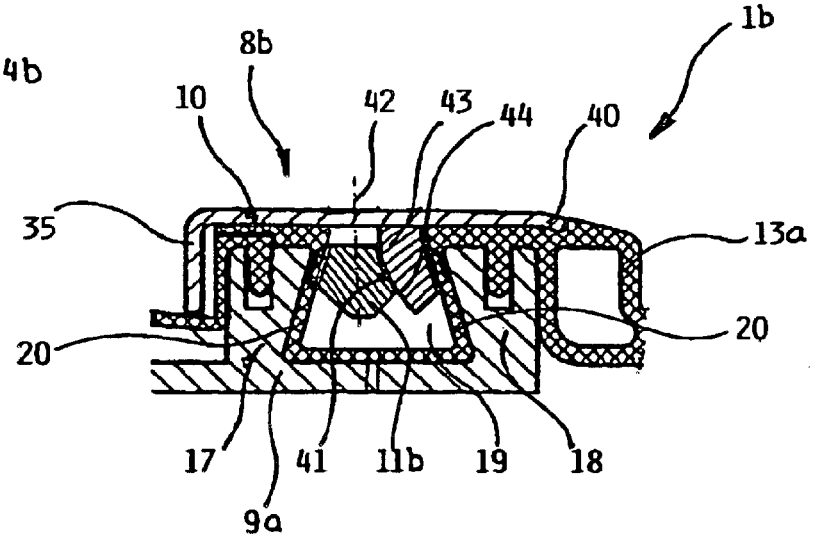

The sealing apparatus 1*b* as shown in FIGS. 4*a* and 4*b* in a sectional view corresponding to that of FIG. 2 differs from the sealing apparatus 1*a* of FIG. 1 merely by a different configuration of the lapped flange 10, and the clamping 11*b* of the anchoring unit 8*b*.

The clamping element 11*b* in the FIGS. 4*a* and 4*b* shows a substantially hexagonal cross section. In comparison with the clamping element 11*a* of the sealing apparatus 1*a* of FIG. 1 the width is clearly reduced and a contact surface 41 is curved in a concave fashion. The clamping element 11*b* further does not comprise a groove, but bores (not shown) in the direction of the illustrated central line 42, which bores are arranged in a successive manner in the longitudinal direction of the clamping element which extends perpendicular to the illustrated sectional view. The clamping element 11*b* is also made as a continuous extruded aluminum profile.

Like the lapped flange 10*a* of FIG. 1, the lapped flange 10 of FIGS. 4*a* and 4*b* is also a sheet steel strip with a cross section bent off in an L-shaped manner which comprises a plurality of sunk bores (not shown) in the direction of the central line 42, which bores are disposed in a successive fashion in its longitudinal direction extending perpendicularly to the illustrated sectional view. A supporting element 43 made of a continuously drawn steel profile is welded together with the lapped flange 10. The supporting element 43 has a substantially rectangular cross section, with a contact surface 44 being curved in a convex manner according to the contact surface 41 of the clamping element 11*b* .

For the purpose of mounting the sealing apparatus 1*b* the lapped flange 10 is pre-mounted with the clamping element 11*b* by means of screws (not shown) engaging through the bores of the lapped flange 10 in the bores of the clamping element 11*b*. As in the sealing apparatus 1*a* of FIG. 1, self-cutting countersunk head screws are used in this case as well.

When the lapped flange 10 is positioned, its shorter, bent-off leg 35 grasps around the holding leg 17 of the integral flange 9*a*. At the same time, the clamping element 11*b*, which is suspended by means of the screws (not shown) and moves in a loose pendulum fashion, is introduced into the dovetail groove 19.

By tightening the screws (not shown) whose heads on their part rest on the sunk bores (not shown) of the lapped flange 10, the clamping element 11*b* is pulled in the dovetail groove 19 in the direction towards the lapped flange 10 and rests on the one hand with its concavely curved contact surface 41 on the convexly curved contact surface 44 of the supporting element 43 and, through the same, on a bearing surface 20 of the dovetail groove 19, and on the other hand directly on the opposite bearing surface 20 of the dovetail groove 19.

In this case too the lapped flange 10 is fixedly connected with the integral flange 9*a* on the one hand. On the other hand, the holding strip of the bridging unit 13 resting in the dovetail groove 19 is clamped between the bearing surfaces 20 of the dovetail groove 19 and the clamping element 11*b* and is fixed in its position. In comparison with the sealing apparatus 1*a* of FIG. 1, the mounting of the sealing apparatus 1*b* in FIGS. 4*a* and 4*b* is again clearly simplified and its mounting can be quickly performed.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. An expansion gap sealing device comprising a flexible bridging unit and two anchoring units for securing said flexible bridging unit in each of said anchoring units, each anchoring unit comprising an integral flange with a respective dovetail groove and an overlapping flange covering said respective dovetail groove, said flexible bridging unit comprising two anchoring portions each with a sectional dovetail configuration fitting into said respective dovetail groove, and an elongated clamping element (11*a*, 11*b*) in said sectional dovetail configuration securing said flexible bridging unit in said respective dovetail groove, said elongated clamping element comprising a rigid body having a cross-section permitting an insertion of said elongated clamping element into said sectional dovetail configuration and permitting a turning of said elongated clamping element about a longitudinal axis of said elongated clamping element, said turning placing said elongated clamping element in an anchoring position, and at least one member (36, 43) securing said elongated clamping element in said respective dovetail groove in said anchoring position.

2. The expansion gap sealing device of claim 1, wherein said cross-section of said rigid body of said elongated clamping element has a narrow dimension permitting said insertion of said elongated clamping element into said sectional dovetail configuration in said dovetail groove, and a wide dimension locking said elongated clamping element in said anchoring position when said turning is complete.

3. The expansion gap sealing device of claim 1, wherein said at least one securing member (36) is a screw passing through said overlapping flange into said elongated clamping element when said elongated clamping element is in its turned anchoring position, whereby said elongated clamping element bears against inwardly facing walls of said sectional dovetail configuration and through said walls against said respective dovetail groove.

4. The expansion gap sealing device of claim 3, wherein said screw is a flathead screw bearing with its screw head against a hole rim in said overlapping flange.

5. The expansion gap sealing device of claim 1, wherein said rigid body of said elongated clamping element comprises a longitudinal groove and wherein said at least one securing member (36) comprises a self-tapping screw engaging said longitudinal groove.

6. The expansion gap sealing device of claim 1, wherein said flexible bridging unit comprises at least one longitudinal sealing lip, and wherein said integral flange comprises at least one lip groove in which said at least one sealing lip is received.

7. The expansion gap sealing device of claim 1, wherein said overlapping flange comprises said securing element (43) formed as an inwardly extending supporting element (43) for securing said elongated clamping element inside said dovetail configuration and inside said dovetail groove whereby said supporting element (43) bears against one inwardly facing surface of said dovetail groove and said elongated clamping element bears against an opposite surface of said dovetail groove when said inwardly extending supporting element of said overlapping flange and said elongated clamping element are inserted into said dovetail configuration.

8. The expansion gap sealing device of claim 7, wherein said elongated clamping element and said inwardly extending supporting element have mutually engaging curved contact surfaces for wedging said elongated clamping element with said supporting element inside said dovetail groove.

9. The expansion gap sealing device of claim 8, wherein said mutually engaging curved contact surfaces comprise a concave surface and a convex surface fitting into said concave surface.

10. The expansion gap sealing device of claim 7, wherein said inwardly extending supporting element is rigidly secured to an inwardly facing surface of said overlapping flange and wherein said elongated clamping element is adjustably secured to said overlapping flange for adjusting the position of said elongated clamping element relative to said supporting element.

11. The expansion gap sealing device of claim 10, further comprising screws (42) adjustably securing said elongated clamping element to said overlapping flange and wherein tightening of said screws (42) pulls said elongated clamping element against said supporting element and against an inwardly facing wall of said dovetail groove.

12. The expansion gap sealing device of claim 1, wherein said integral flange comprises two legs **(17*a*, 18; 17) having slanted bearing surfaces facing each other and forming said dovetail groove (19)**, said two legs having a spring elastic characteristic.

13. The expansion gap sealing device of claim 1, wherein said elongated clamping element and said integral flange are made of metal having a material strength and rigidity that is the same for said elongated clamping element and for said integral flange.

* * * * *